US009812149B2

(12) United States Patent
Yen

(10) Patent No.: US 9,812,149 B2
(45) **Date of Patent: *Nov. 7, 2017**

(54) METHODS AND SYSTEMS FOR PROVIDING CONSISTENCY IN NOISE REDUCTION DURING SPEECH AND NON-SPEECH PERIODS

(71) Applicant: Knowles Electronics, LLC, Itasca, IL (US)

(72) Inventor: Kuan-Chieh Yen, Foster City, CA (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/009,740

(22) Filed: Jan. 28, 2016

(65) Prior Publication Data

US 2017/0221501 A1 Aug. 3, 2017

(51) Int. Cl.
*G10L 21/00* (2013.01)
*G10L 21/0216* (2013.01)
(Continued)

(52) U.S. Cl.
CPC ..... *G10L 21/0216* (2013.01); *G10L 21/0232* (2013.01); *G10L 25/21* (2013.01);
(Continued)

(58) Field of Classification Search
CPC ..... H04R 3/005
See application file for complete search history.

(56) References Cited

U.S. PATENT DOCUMENTS 2,535,063 A 12/1950 Halstead
3,995,113 A 11/1976 Tani
(Continued)

FOREIGN PATENT DOCUMENTS

CN 204119490 U 1/2015
CN 204145685 U 2/2015
(Continued)

OTHER PUBLICATIONS

Westerlund et al., "In-ear Microphone Equalization Exploiting an Active Noise Control." Proceedings of Internoise 2001, Aug. 2001, pp. 1-6. 17.*

(Continued)

*Primary Examiner* — Fariba Sirjani
(74) *Attorney, Agent, or Firm* — Foley & Lardner LLP

(57) ABSTRACT

Methods and systems for providing consistency in noise reduction during speech and non-speech periods are provided. First and second signals are received. The first signal includes at least a voice component. The second signal includes at least the voice component modified by human tissue of a user. First and second weights may be assigned per subband to the first and second signals, respectively. The first and second signals are processed to obtain respective first and second full-band power estimates. During periods when the user's speech is not present, the first weight and the second weight are adjusted based at least partially on the first full-band power estimate and the second full-band power estimate. The first and second signals are blended based on the adjusted weights to generate an enhanced voice signal. The second signal may be aligned with the first signal prior to the blending.

24 Claims, 5 Drawing Sheets

(51) Int. Cl.

| | |
|---|---|
| ***G10L 25/21*** | (2013.01) |
| ***G10L 25/93*** | (2013.01) |
| ***G10L 21/0232*** | (2013.01) |
| ***H04R 3/00*** | (2006.01) |

(52) U.S. Cl.

CPC ..... *G10L 25/93* (2013.01); *H04R 3/005* (2013.01); *G10L 2021/02166* (2013.01); *G10L 2021/02168* (2013.01); *G10L 2025/937* (2013.01)

(56) References Cited

U.S. PATENT DOCUMENTS 4,150,262 A 4/1979 Ono
4,455,675 A 6/1984 Bose et al.
4,516,428 A 5/1985 Konomi
4,520,238 A 5/1985 Ikeda
4,588,867 A 5/1986 Konomi
4,596,903 A 6/1986 Yoshizawa
4,644,581 A 2/1987 Sapiejewski
4,652,702 A 3/1987 Yoshii
4,696,045 A 9/1987 Rosenthal
4,761,825 A * 8/1988 Ma ..... H03J 7/065 455/183.2
4,975,967 A 12/1990 Rasmussen
5,208,867 A 5/1993 Stites, III
5,222,050 A 6/1993 Marren et al.
5,251,263 A 10/1993 Andrea et al.
5,282,253 A 1/1994 Konomi
5,289,273 A 2/1994 Lang
5,295,193 A 3/1994 Ono
5,305,387 A 4/1994 Sapiejewski
5,319,717 A 6/1994 Holesha
5,327,506 A 7/1994 Stites, III
D360,691 S 7/1995 Mostardo
D360,948 S 8/1995 Mostardo
D360,949 S 8/1995 Mostardo
5,490,220 A 2/1996 Loeppert
5,734,621 A 3/1998 Ito
5,870,482 A 2/1999 Loeppert et al.
D414,493 S 9/1999 Jiann-Yeong
5,960,093 A 9/1999 Miller
5,983,073 A 11/1999 Ditzik
6,044,279 A 3/2000 Hokao et al.
6,061,456 A 5/2000 Andrea et al.
6,094,492 A 7/2000 Boesen
6,118,878 A 9/2000 Jones
6,122,388 A 9/2000 Feldman
6,130,953 A 10/2000 Wilton et al.
6,184,652 B1 2/2001 Yang
6,211,649 B1 4/2001 Matsuda
6,219,408 B1 4/2001 Kurth
6,255,800 B1 7/2001 Bork
D451,089 S 11/2001 Hohl et al.
6,362,610 B1 3/2002 Yang
6,373,942 B1 4/2002 Braund
6,408,081 B1 6/2002 Boesen
6,453,289 B1 * 9/2002 Ertem ..... G10L 21/0208 704/225
6,462,668 B1 10/2002 Foseide
6,535,460 B2 3/2003 Loeppert et al.
6,567,524 B1 5/2003 Svean et al.
6,661,901 B1 12/2003 Svean et al.
6,683,965 B1 1/2004 Sapiejewski
6,694,180 B1 2/2004 Boesen
6,717,537 B1 4/2004 Fang et al.
6,738,485 B1 5/2004 Boesen
6,748,095 B1 6/2004 Goss
6,751,326 B2 6/2004 Nepomuceno
6,754,358 B1 6/2004 Boesen et al.
6,754,359 B1 6/2004 Svean et al.
6,757,395 B1 6/2004 Fang et al.
6,801,632 B2 10/2004 Olson
6,847,090 B2 1/2005 Loeppert
6,879,698 B2 4/2005 Boesen
6,920,229 B2 7/2005 Boesen
6,931,292 B1 8/2005 Brumitt et al.
6,937,738 B2 8/2005 Armstrong et al.
6,987,859 B2 1/2006 Loeppert et al.
7,023,066 B2 4/2006 Lee et al.
7,024,010 B2 4/2006 Saunders et al.
7,039,195 B1 5/2006 Svean et al.
7,103,188 B1 9/2006 Jones
7,127,389 B2 * 10/2006 Chazan ..... G10L 25/90 704/205
7,132,307 B2 11/2006 Wang et al.
7,136,500 B2 11/2006 Collins
7,203,331 B2 4/2007 Boesen
7,209,569 B2 4/2007 Boesen
7,215,790 B2 5/2007 Boesen et al.
7,289,636 B2 10/2007 Saunders et al.
7,302,074 B2 11/2007 Wagner et al.
D573,588 S 7/2008 Warren et al.
7,406,179 B2 7/2008 Ryan
7,433,481 B2 10/2008 Armstrong et al.
7,477,754 B2 1/2009 Rasmussen et al.
7,477,756 B2 1/2009 Wickstrom et al.
7,502,484 B2 * 3/2009 Ngia ..... G10L 15/02 381/312
7,590,254 B2 9/2009 Olsen
7,680,292 B2 3/2010 Warren et al.
7,747,032 B2 6/2010 Zei et al.
7,773,759 B2 8/2010 Alves et al.
7,869,610 B2 1/2011 Jayanth et al.
7,889,881 B2 2/2011 Ostrowski
7,899,194 B2 3/2011 Boesen
7,965,834 B2 * 6/2011 Alves ..... G10L 21/0208 379/406.13
7,983,433 B2 7/2011 Nemirovski
8,005,249 B2 8/2011 Wirola et al.
8,019,107 B2 * 9/2011 Ngia ..... H04R 1/1091 381/338
8,027,481 B2 9/2011 Beard
8,045,724 B2 10/2011 Sibbald
8,072,010 B2 12/2011 Lutz
8,077,873 B2 12/2011 Shridhar et al.
8,081,780 B2 12/2011 Goldstein et al.
8,103,029 B2 1/2012 Ngia et al.
8,111,853 B2 2/2012 Isvan
8,116,489 B2 2/2012 Mejia et al.
8,116,502 B2 2/2012 Saggio, Jr. et al.
8,135,140 B2 3/2012 Shridhar et al.
8,180,067 B2 5/2012 Soulodre
8,189,799 B2 5/2012 Shridhar et al.
8,194,880 B2 6/2012 Avendano
8,199,924 B2 6/2012 Wertz et al.
8,213,643 B2 7/2012 Hemer
8,213,645 B2 7/2012 Rye et al.
8,229,125 B2 7/2012 Short
8,229,740 B2 7/2012 Nordholm et al.
8,238,567 B2 8/2012 Burge et al.
8,249,287 B2 8/2012 Silvestri et al.
8,254,591 B2 8/2012 Goldstein et al.
8,270,626 B2 9/2012 Shridhar et al.
8,285,344 B2 10/2012 Kahn et al.
8,295,503 B2 10/2012 Sung et al.
8,311,253 B2 11/2012 Silvestri et al.
8,315,404 B2 11/2012 Shridhar et al.
8,325,963 B2 12/2012 Kimura
8,331,604 B2 12/2012 Saito et al.
8,363,823 B1 1/2013 Santos
8,376,967 B2 2/2013 Mersky
8,385,560 B2 2/2013 Solbeck et al.
8,401,200 B2 3/2013 Tiscareno et al.
8,401,215 B2 3/2013 Warren et al.
8,416,979 B2 4/2013 Takai
8,462,956 B2 6/2013 Goldstein et al.
8,473,287 B2 6/2013 Every et al.
8,483,418 B2 7/2013 Platz et al.
8,488,831 B2 7/2013 Saggio, Jr. et al.
8,494,201 B2 7/2013 Anderson
8,498,428 B2 7/2013 Schreuder et al.
8,503,689 B2 8/2013 Schreuder et al.
8,503,704 B2 8/2013 Francart et al.

(56) References Cited

U.S. PATENT DOCUMENTS 8,509,465 B2 8/2013 Theverapperuma
8,526,646 B2 9/2013 Boesen
8,532,323 B2 9/2013 Wickstrom et al.
8,553,899 B2 10/2013 Salvetti et al.
8,553,923 B2 10/2013 Tiscareno et al.
8,571,227 B2 10/2013 Donaldson et al.
8,594,353 B2 11/2013 Anderson
8,620,650 B2 12/2013 Walters et al.
8,634,576 B2 1/2014 Salvetti et al.
8,655,003 B2 * 2/2014 Duisters ..... H04R 1/1041 381/375
8,666,102 B2 3/2014 Bruckhoff et al.
8,681,999 B2 3/2014 Theverapperuma et al.
8,682,001 B2 3/2014 Annunziato et al.
8,705,787 B2 * 4/2014 Larsen ..... H04R 1/1016 181/129
8,837,746 B2 9/2014 Burnett
8,942,976 B2 1/2015 Li et al.
8,983,083 B2 3/2015 Tiscareno et al.
9,014,382 B2 4/2015 Van De Par et al.
9,025,415 B2 5/2015 Derkx
9,042,588 B2 5/2015 Aase
9,047,855 B2 6/2015 Bakalos
9,078,064 B2 7/2015 Wickstrom et al.
9,100,756 B2 8/2015 Dusan et al.
9,107,008 B2 8/2015 Leitner
9,123,320 B2 9/2015 Carreras et al.
9,154,868 B2 10/2015 Narayan et al.
9,167,337 B2 10/2015 Shin
9,185,487 B2 11/2015 Solbach et al.
9,208,769 B2 12/2015 Azmi
9,226,068 B2 12/2015 Hendrix et al.
9,264,823 B2 2/2016 Bajic et al.
9,401,158 B1 * 7/2016 Yen ..... G10L 21/0216
2001/0011026 A1 8/2001 Nishijima
2001/0021659 A1 9/2001 Okamura
2001/0049262 A1 12/2001 Lehtonen
2002/0016188 A1 2/2002 Kashiwamura
2002/0021800 A1 2/2002 Bodley et al.
2002/0038394 A1 3/2002 Liang et al.
2002/0054684 A1 5/2002 Menzl
2002/0056114 A1 5/2002 Fillebrown et al.
2002/0067825 A1 6/2002 Baranowski et al.
2002/0098877 A1 7/2002 Glezerman
2002/0136420 A1 9/2002 Topholm
2002/0159023 A1 10/2002 Swab
2002/0176330 A1 11/2002 Ramonowski et al.
2002/0183089 A1 12/2002 Heller et al.
2003/0002704 A1 1/2003 Pronk
2003/0013411 A1 1/2003 Uchiyama
2003/0017805 A1 1/2003 Yeung et al.
2003/0058808 A1 3/2003 Eaton et al.
2003/0085070 A1 5/2003 Wickstrom
2003/0198357 A1 * 10/2003 Schneider ..... G10L 21/0208 381/94.2
2003/0207703 A1 11/2003 Liou et al.
2003/0223592 A1 12/2003 Deruginsky et al.
2005/0027522 A1 2/2005 Yamamoto et al.
2005/0222842 A1 * 10/2005 Zakarauskas ..... G10L 21/0208 704/233
2006/0029234 A1 2/2006 Sargaison
2006/0034472 A1 2/2006 Bazarjani et al.
2006/0153155 A1 7/2006 Jacobsen et al.
2006/0227990 A1 10/2006 Kirchhoefer
2006/0239472 A1 10/2006 Oda
2007/0104340 A1 5/2007 Miller et al.
2007/0147635 A1 6/2007 Dijkstra et al.
2008/0019548 A1 1/2008 Avendano
2008/0037801 A1 * 2/2008 Alves ..... G10L 21/02 381/71.6
2008/0063228 A1 3/2008 Mejia et al.
2008/0101640 A1 5/2008 Ballad et al.
2008/0181419 A1 * 7/2008 Goldstein ..... H04R 3/002 381/57
2008/0232621 A1 9/2008 Burns
2008/0260180 A1 * 10/2008 Goldstein ..... H04R 25/50 381/110
2009/0010456 A1 * 1/2009 Goldstein ..... H04R 25/02 381/110
2009/0034765 A1 * 2/2009 Boillot ..... H04R 25/02 381/309
2009/0041269 A1 2/2009 Hemer
2009/0067661 A1 * 3/2009 Keady ..... H04R 1/1091 381/375
2009/0080670 A1 3/2009 Solbeck et al.
2009/0147966 A1 * 6/2009 McIntosh ..... H04R 3/005 381/71.11
2009/0182913 A1 7/2009 Rosenblatt et al.
2009/0207703 A1 8/2009 Matsumoto et al.
2009/0214068 A1 8/2009 Wickstrom
2009/0264161 A1 * 10/2009 Usher ..... H04M 1/22 455/570
2009/0323982 A1 12/2009 Solbach et al.
2010/0022280 A1 * 1/2010 Schrage ..... H04M 1/58 455/567
2010/0074451 A1 * 3/2010 Usher ..... H04R 25/70 381/58
2010/0081487 A1 4/2010 Chen et al.
2010/0183167 A1 7/2010 Phelps et al.
2010/0233996 A1 9/2010 Herz et al.
2010/0270631 A1 10/2010 Renner
2011/0125063 A1 * 5/2011 Shalon ..... A61B 5/0006 600/590
2011/0125491 A1 * 5/2011 Alves ..... G10L 21/0364 704/207
2011/0257967 A1 10/2011 Every et al.
2011/0293103 A1 * 12/2011 Park ..... G10K 11/1782 381/57
2012/0008808 A1 1/2012 Saltykov
2012/0020505 A1 * 1/2012 Yamada ..... G10L 17/005 381/313
2012/0056282 A1 3/2012 Van Lippen et al.
2012/0099753 A1 4/2012 van der Avoort et al.
2012/0197638 A1 8/2012 Li et al.
2012/0321103 A1 12/2012 Smailagic et al.
2013/0024194 A1 1/2013 Zhao et al.
2013/0051580 A1 2/2013 Miller
2013/0058495 A1 3/2013 Furst et al.
2013/0070935 A1 3/2013 Hui et al.
2013/0142358 A1 6/2013 Schultz et al.
2013/0272564 A1 10/2013 Miller
2013/0287219 A1 10/2013 Hendrix et al.
2013/0315415 A1 11/2013 Shin
2013/0322642 A1 12/2013 Streitenberger et al.
2013/0343580 A1 12/2013 Lautenschlager et al.
2013/0345842 A1 12/2013 Karakaya et al.
2014/0010378 A1 1/2014 Voix et al.
2014/0044275 A1 2/2014 Goldstein et al.
2014/0086425 A1 3/2014 Jensen et al.
2014/0169579 A1 6/2014 Azmi
2014/0177869 A1 * 6/2014 Percy ..... H04R 3/005 381/97
2014/0233741 A1 8/2014 Gustavsson
2014/0254825 A1 * 9/2014 Tahernezhadi ..... H04R 3/02 381/93
2014/0270231 A1 9/2014 Dusan et al.
2014/0273851 A1 9/2014 Donaldson et al.
2014/0314238 A1 * 10/2014 Usher ..... G10L 19/008 381/17
2014/0348346 A1 11/2014 Fukuda
2014/0355787 A1 12/2014 Jiles et al.
2014/0369517 A1 * 12/2014 Zhou ..... G10K 11/1784 381/71.11
2015/0025881 A1 1/2015 Carlos et al.
2015/0043741 A1 2/2015 Shin
2015/0055810 A1 2/2015 Shin
2015/0078574 A1 3/2015 Shin
2015/0110280 A1 4/2015 Wardle
2015/0131814 A1 * 5/2015 Usher ..... G06F 3/017 381/123
2015/0161981 A1 6/2015 Kwatra

(56) References Cited

U.S. PATENT DOCUMENTS

| | | | | |
|---|---|---|---|---|
| 2015/0172814 | A1* | 6/2015 | Usher | H04R 3/005 381/92 |
| 2015/0215701 | A1* | 7/2015 | Usher | H04R 1/1041 381/71.6 |
| 2015/0237448 | A1 | 8/2015 | Loeppert | |
| 2015/0243271 | A1 | 8/2015 | Goldstein | |
| 2015/0245129 | A1 | 8/2015 | Dusan et al. | |
| 2015/0264472 | A1 | 9/2015 | Aase | |
| 2015/0296305 | A1 | 10/2015 | Shao et al. | |
| 2015/0296306 | A1 | 10/2015 | Shao et al. | |
| 2015/0304770 | A1 | 10/2015 | Watson et al. | |
| 2015/0310846 | A1 | 10/2015 | Andersen et al. | |
| 2015/0325229 | A1 | 11/2015 | Carreras et al. | |
| 2015/0325251 | A1 | 11/2015 | Dusan et al. | |
| 2015/0365770 | A1 | 12/2015 | Lautenschlager | |
| 2015/0382094 | A1 | 12/2015 | Grinker et al. | |
| 2016/0007119 | A1 | 1/2016 | Harrington | |
| 2016/0021480 | A1 | 1/2016 | Johnson et al. | |
| 2016/0029345 | A1 | 1/2016 | Sebeni et al. | |
| 2016/0037261 | A1 | 2/2016 | Harrington | |
| 2016/0037263 | A1 | 2/2016 | Pal et al. | |
| 2016/0042666 | A1 | 2/2016 | Hughes | |
| 2016/0044151 | A1 | 2/2016 | Shoemaker et al. | |
| 2016/0044398 | A1 | 2/2016 | Siahaan et al. | |
| 2016/0044424 | A1 | 2/2016 | Dave et al. | |
| 2016/0060101 | A1 | 3/2016 | Loeppert | |
| 2016/0105748 | A1 | 4/2016 | Pal et al. | |
| 2016/0112811 | A1* | 4/2016 | Jensen | H04R 5/033 381/17 |
| 2016/0150335 | A1 | 5/2016 | Qutub et al. | |
| 2016/0155453 | A1* | 6/2016 | Harvey | H04R 3/005 381/26 |
| 2016/0165334 | A1 | 6/2016 | Grossman | |
| 2016/0165361 | A1 | 6/2016 | Miller et al. | |

FOREIGN PATENT DOCUMENTS

| | | | |
|---|---|---|---|
| CN | 204168483 | U | 2/2015 |
| CN | 204669605 | U | 9/2015 |
| CN | 204681587 | U | 9/2015 |
| CN | 204681593 | U | 9/2015 |
| CN | ZL2015203769650 | | 9/2015 |
| CN | ZL2015204747042 | | 9/2015 |
| CN | ZL2015204903074 | | 9/2015 |
| DE | 915826 | | 7/1954 |
| DE | 3723275 | | 3/1988 |
| DE | 102009051713 | | 5/2011 |
| DE | 102011003470 | | 8/2012 |
| EP | 0124870 | | 11/1984 |
| EP | 0500985 | | 9/1992 |
| EP | 0684750 | | 11/1995 |
| EP | 0806909 | | 11/1997 |
| EP | 1299988 | | 4/2003 |
| EP | 1509065 | | 2/2005 |
| EP | 1310136 | B1 | 3/2006 |
| EP | 1469701 | B1 | 4/2008 |
| EP | 2434780 | | 3/2012 |
| JP | S5888996 | A | 5/1983 |
| JP | S60103798 | | 6/1985 |
| JP | 2007150743 | A | 6/2007 |
| JP | 2012169828 | A | 9/2012 |
| JP | 5049312 | B2 | 10/2012 |
| KR | 20110058769 | A | 6/2011 |
| KR | 101194904 | B1 | 10/2012 |
| KR | 1020140026722 | A | 3/2014 |
| WO | WO8303733 | | 10/1983 |
| WO | WO9407342 | | 3/1994 |
| WO | WO9623443 | | 8/1996 |
| WO | WO0025551 | | 5/2000 |
| WO | WO0217835 | | 3/2002 |
| WO | WO0217836 | | 3/2002 |
| WO | WO0217837 | | 3/2002 |
| WO | WO0217838 | | 3/2002 |
| WO | WO0217839 | | 3/2002 |
| WO | WO03073790 | | 9/2003 |
| WO | WO2006114767 | A1 | 11/2006 |
| WO | WO2007073818 | | 7/2007 |
| WO | WO2007082579 | | 7/2007 |
| WO | WO2007147416 | | 12/2007 |
| WO | WO2008128173 | | 10/2008 |
| WO | WO2009012491 | | 1/2009 |
| WO | WO2009023784 | | 2/2009 |
| WO | WO2011051469 | | 5/2011 |
| WO | WO2011061483 | | 5/2011 |
| WO | WO2013033001 | A1 | 3/2013 |
| WO | WO-2014/022359 | A2 | 2/2014 |
| WO | WO2016085814 | A1 | 6/2016 |
| WO | WO2016089671 | A1 | 6/2016 |
| WO | WO2016089745 | A1 | 6/2016 |

OTHER PUBLICATIONS

Yen, Kuan-Chieh et al., "Microphone Signal Fusion", U.S. Appl. No. 14/853,947, filed Sep. 14, 2015.

Yen, Kuan-Chieh et al., "Audio Monitoring and Adaptation Using Headset Microphones Inside User's Ear Canal", U.S. Appl. No. 14/985,187, filed Dec. 30, 2015.

Gadonniex, Sharon et al., "Occlusion Reduction and Active Noise Reduction Based on Seal Quality", U.S. Appl. No. 14/985,057, filed Dec. 30, 2015.

Miller, Thomas E. et al., "Voice-Enhanced Awareness Mode", U.S. Appl. No. 14/985,112, filed Dec. 30, 2015.

Verma, Tony, "Context Aware False Acceptance Rate Reduction", U.S. Appl. No. 14/749,425, filed Jun. 24, 2015.

Notice of Allowance, dated Mar. 21, 2016, U.S. Appl. No. 14/853,947, filed Sep. 14, 2015.

Final Office Action, dated May 12, 2016, U.S. Appl. No. 13/224,068, filed Sep. 1, 2011.

Ephraim, Y. et al., "Speech enhancement using a minimum mean-square error short-time spectral amplitude estimator," IEEE Transactions on Acoustics, Speech, and Signal Processing, vol. ASSP-32, No. 6, Dec. 1984, pp. 1109-1121.

Sun et al., "Robust Noise Estimation Using Minimum Correction with Harmonicity Control." Conference: Interspeech 2010, 11th Annual Conference of the International Speech Communication Association, Makuhari, Chiba, Japan, Sep. 26-30, 2010. p. 1085-1088.

Lomas, "Apple Patents Earbuds With Noise-Canceling Sensor Smarts," Aug. 27, 2015. [retrieved on Sep. 16, 2015]. TechCrunch. Retrieved from the Internet: <URL: http://techcrunch.com/2015/08/27/apple-wireless-earbuds-at-last/>. 2 pages.

Smith, Gina, "New Apple Patent Applications: The Sound of Hearables to Come," aNewDomain, Feb. 12, 2016, accessed Mar. 2, 2016 at URL: <http://anewdomain.net/2016/02/12/new-apple-patent-applications-glimpse-hearables-come/>.

Qutub, Sarmad et al., "Acoustic Apparatus with Dual MEMS Devices," U.S. Appl. No. 14/872,887, filed Oct. 1, 2015.

Office Action dated Feb. 4, 2016 in U.S. Appl. No. 14/318,436, filed Jun. 27, 2014.

Office Action dated Jan. 22, 2016 in U.S. Appl. No. 14/774,666, filed Sep. 10, 2015.

International Search Report and Written Opinion for Patent Cooperation Treaty Application No. PCT/US2015/062940 dated Mar. 28, 2016 (10 pages).

International Search Report and Written Opinion for Patent Cooperation Treaty Application No. PCT/US2015/062393 dated Apr. 8, 2016 (9 pages).

International Search Report and Written Opinion for Patent Cooperation Treaty Application No. PCT/US2015/061871 dated Mar. 29, 2016 (9 pages).

Hegde, Nagaraj, "Seamlessly Interfacing MEMS Microphones with BlackfinTM Processors", EE350 Analog Devices, Rev. 1, Aug. 2010, pp. 1-10.

Korean Office Action regarding Application No. 10-2014-7008553, dated May 21, 2015.

(56) References Cited

OTHER PUBLICATIONS

Written Opinion of the International Searching Authority and International Search Report mailed Jan. 21, 2013 in Patent Cooperation Treaty Application No. PCT/US2012/052478, filed Aug. 27, 2012.
Langberg, Mike, "Bluelooth Sharpens Its Connections," Chicago Tribune, Apr. 29, 2002, Business Section, p. 3, accessed Mar. 11, 2016 at URL: <http://articles.chicagotribune.com/2002-04-29/business/0204290116_1_bluetooth-enabled-bluetooth-headset-bluetooth-devices>.
*Duplan Corporaton* vs. *Deering Milliken* decision, 197 USPQ 342.
Combined Bluetooth Headset and USB Dongle, Advance Information, RTX Telecom A/S, vol. 1, Apr. 6, 2002.
Notice of Allownace, dated Sep. 27, 2012, U.S. Appl. No. 13/568,989, filed Aug. 7, 2012.
Non-Final Office Action, dated Sep. 23, 2015, U.S. Appl. No. 13/224,068, filed Sep. 1, 2011.
Non-Final Office Action, dated Mar. 10, 2004, U.S. Appl. No. 10/138,929, filed May 3, 2002.
Final Office Action, dated Jan. 12, 2005, U.S. Appl. No. 10/138,929, filed May 3, 2002.
Non-Final Office Action, dated Jan. 12, 2006, U.S. Appl. No. 10/138,929, filed May 3, 2002.
Non-Final Office Action, dated Nov. 4, 2015, U.S. Appl. No. 14/853,947, filed Sep. 14, 2015.
International Search Report and Written Opinion, PCT/US2016/069094, Knowles Electronics, LLC, 11 pages (dated May 23, 2017).

* cited by examiner

METHODS AND SYSTEMS FOR PROVIDING CONSISTENCY IN NOISE REDUCTION DURING SPEECH AND NON-SPEECH PERIODS

FIELD

The present application relates generally to audio processing and, more specifically, to systems and methods for providing noise reduction that has consistency between speech-present periods and speech-absent periods (speech gaps).

BACKGROUND

The proliferation of smart phones, tablets, and other mobile devices has fundamentally changed the way people access information and communicate. People now make phone calls in diverse places such as crowded bars, busy city streets, and windy outdoors, where adverse acoustic conditions pose severe challenges to the quality of voice communication. Additionally, voice commands have become an important method for interaction with electronic devices in applications where users have to keep their eyes and hands on the primary task, such as, for example, driving. As electronic devices become increasingly compact, voice command may become the preferred method of interaction with electronic devices. However, despite recent advances in speech technology, recognizing voice in noisy conditions remains difficult. Therefore, mitigating the impact of noise is important to both the quality of voice communication and performance of voice recognition.

Headsets have been a natural extension of telephony terminals and music players as they provide hands-free convenience and privacy when used. Compared to other hands-free options, a headset represents an option in which microphones can be placed at locations near the user's mouth, with constrained geometry among user's mouth and microphones. This results in microphone signals that have better signal-to-noise ratios (SNRs) and are simpler to control when applying multi-microphone based noise reduction. However, when compared to traditional handset usage, headset microphones are relatively remote from the user's mouth. As a result, the headset does not provide the noise shielding effect provided by the user's hand and the bulk of the handset. As headsets have become smaller and lighter in recent years due to the demand for headsets to be subtle and out-of-way, this problem becomes even more challenging.

When a user wears a headset, the user's ear canals are naturally shielded from outside acoustic environment. If a headset provides tight acoustic sealing to the ear canal, a microphone placed inside the ear canal (the internal microphone) would be acoustically isolated from the outside environment such that environmental noise would be significantly attenuated. Additionally, a microphone inside a sealed ear canal is free of wind-buffeting effect. A user's voice can be conducted through various tissues in a user's head to reach the ear canal, because the sound is trapped inside of the ear canal. A signal picked up by the internal microphone should thus have much higher SNR compared to the microphone outside of the user's ear canal (the external microphone).

Internal microphone signals are not free of issues, however. First of all, the body-conducted voice tends to have its high-frequency content severely attenuated and thus has much narrower effective bandwidth compared to voice conducted through air. Furthermore, when the body-conducted voice is sealed inside an ear canal, it forms standing waves inside the ear canal. As a result, the voice picked up by the internal microphone often sounds muffled and reverberant while lacking the natural timbre of the voice picked up by the external microphones. Moreover, effective bandwidth and standing-wave patterns vary significantly across different users and headset fitting conditions. Finally, if a loudspeaker is also located in the same ear canal, sounds made by the loudspeaker would also be picked by the internal microphone. Even with acoustic echo cancellation (AEC), the close coupling between the loudspeaker and internal microphone often leads to severe voice distortion even after AEC.

Other efforts have been attempted in the past to take advantage of the unique characteristics of the internal microphone signal for superior noise reduction performance. However, attaining consistent performance across different users and different usage conditions has remained challenging. It can be particularly challenging to provide robustness and consistency for noise reduction both when the user is speaking and in gaps when the user is not speaking (speech gaps). Some known methods attempt to address this problem; however, those methods may be more effective when the user's speech is present but less so when the user's speech is absent. What is needed is a method that overcomes the drawbacks of the known methods. More specifically, what is needed is a method that improves noise reduction performance during speech gaps such that it is not inconsistent with the noise reduction performance during speech periods.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Methods and systems for providing consistency in noise reduction during speech and non-speech periods are provided. An example method includes receiving a first audio signal and a second audio signal. The first audio signal includes at least a voice component. The second audio signal includes at least the voice component modified by at least a human tissue of a user. The voice component may be the speech of the user. The first and second audio signals including periods where the speech of the user is not present. The method can also include assigning a first weight to the first audio signal and a second weight to the second audio signal. The method also includes processing the first audio signal to obtain a first full-band power estimate. The method also includes processing the second audio signal to obtain a second full-band power estimate. For the periods when the user's speech is not present, the method includes adjusting, based at least partially on the first full-band power estimate and the second full-band power estimate, the first weight and the second weight. The method also includes blending, based on the first weight and the second weight, the first signal and the second signal to generate an enhanced voice signal.

In some embodiments, the first signal and the second signal are transformed into subband signals. In other embodiments, assigning the first weight and the second weight is performed per subband and based on SNR estimates for the subband. The first signal is processed to obtain a first SNR for the subband and the second signal is processed to obtain a second SNR for the subband. If the first SNR is larger than the second SNR, the first weight for the subband receives a larger value than the second weight for the subband. Otherwise, if the second SNR is larger than the first SNR, the second weight for the subband receives a larger value than the first weight for the subband. In some embodiments, the difference between the first weight and the second weight corresponds to the difference between the first SNR and the second SNR for the subband. However, this SNR-based method is more effective when the user's speech is present but less effective when the user's speech is absent. More specifically, when the user's speech is present, according to this example, selecting the signal with a higher SNR leads to the selection of the signal with lower noise. Because the noise in the ear canal tends to be 20-30 dB lower than the noise outside, there is typically a 20-30 dB noise reduction relative to the external microphone signal. However, when the user's speech is absent, in this example, the SNR is 0 at both the internal and external microphone signals. Deciding the weights based only on the SNRs, as in the SNR-based method, would lead to evenly split weights when the user's speech is absent in this example. As a result, only 3-6 dB of noise reduction is typically achieved relative to the external microphone signal when only the SNR-based method is used.

To mitigate this deficiency of SNR-based mixing methods during speech-absent periods (speech gaps), the full-band noise power is used, in various embodiments, to decide the mixing weights during the speech gaps. Because there is no speech, lower full-band power means there is lower noise power. The method, according to various embodiments, selects the signals with lower full-band power in order to maintain the 20-30 dB noise reduction in speech gaps. In some embodiments, during the speech gaps, adjusting the first weight and the second weight includes determining a minimum value between the first full-band power estimate and the second full-band power estimate. When the minimum value corresponds to the first full-band power estimate, the first weight is increased and the second weight is decreased. When the minimum value corresponds to the second full-band power estimate, the second weight is increased and the first weight is decreased. In some embodiments, the weights are increased and decreased by applying a shift. In various embodiments, the shift is calculated based on a difference between the first full-band power estimate and the second full-band power estimate. The shift receives a larger value for a larger difference value. In certain embodiments, the shift is applied only after determining that the difference exceeds a pre-determined threshold. In other embodiments, a ratio of the first full-band power estimate to the second full-band power estimate is calculated. The shift is calculated based on the ratio. The shift receives a larger value the further the value of ratio is from 1.

In some embodiments, the second audio signal represents at least one sound captured by an internal microphone located inside an ear canal. In certain embodiments, the internal microphone is at least partially sealed for isolation from acoustic signals external to the ear canal.

In some embodiments, the first signal represents at least one sound captured by an external microphone located outside an ear canal. In some embodiments, prior to associating the first weight and the second weight, the second signal is aligned with the first signal. In some embodiments, the assigning of the first weight and the second weight includes determining, based on the first signal, a first noise estimate and determining, based on the second signal, a second noise estimate. The first weight and the second weight can be calculated based on the first noise estimate and the second noise estimate.

In some embodiments, blending includes mixing the first signal and the second signal according to the first weight and the second weight. According to another example embodiment of the present disclosure, the steps of the method for providing consistency in noise reduction during speech and non-speech periods are stored on a non-transitory machine-readable medium comprising instructions, which, when implemented by one or more processors, perform the recited steps.

Other example embodiments of the disclosure and aspects will become apparent from the following description taken in conjunction with the following drawings.

BRIEF DESCRIPTION OF THE DRAWINGS

Embodiments are illustrated by way of example and not limitation in the figures of the accompanying drawings, in which like references indicate similar elements.

DETAILED DESCRIPTION

The present technology provides systems and methods for audio processing which can overcome or substantially alleviate problems associated with ineffective noise reduction during speech-absent periods. Embodiments of the present technology can be practiced on any earpiece-based audio device that is configured to receive and/or provide audio such as, but not limited to, cellular phones, MP3 players, phone handsets and headsets. While some embodiments of the present technology are described in reference to operation of a cellular phone, the present technology can be practiced with any audio device.

According to an example embodiment, the method for audio processing includes receiving a first audio signal and a second audio signal. The first audio signal includes at least a voice component. The second audio signal includes the voice component modified by at least a human tissue of a user, the voice component being speech of the user. The first and second audio signals may include periods when the speech of the user is not present. The first and second audio signals may be transformed into subband signals. The example method includes assigning, per subband, a first weight to the first audio signal and a second weight to the second audio signal. The example method includes processing the first audio signal to obtain a first full-band power estimate. The example method includes processing the second audio signal to obtain a second full-band power estimate. For the periods when the user's speech is not present (speech gaps), the example method includes adjusting, based at least partially on the first full-band power estimate and the second full-band power estimate, the first weight and the second weight. The example method also includes blending, based on the adjusted first weight and the adjusted second weight, the first audio signal and the second audio signal to generate an enhanced voice signal.

Figure 1:
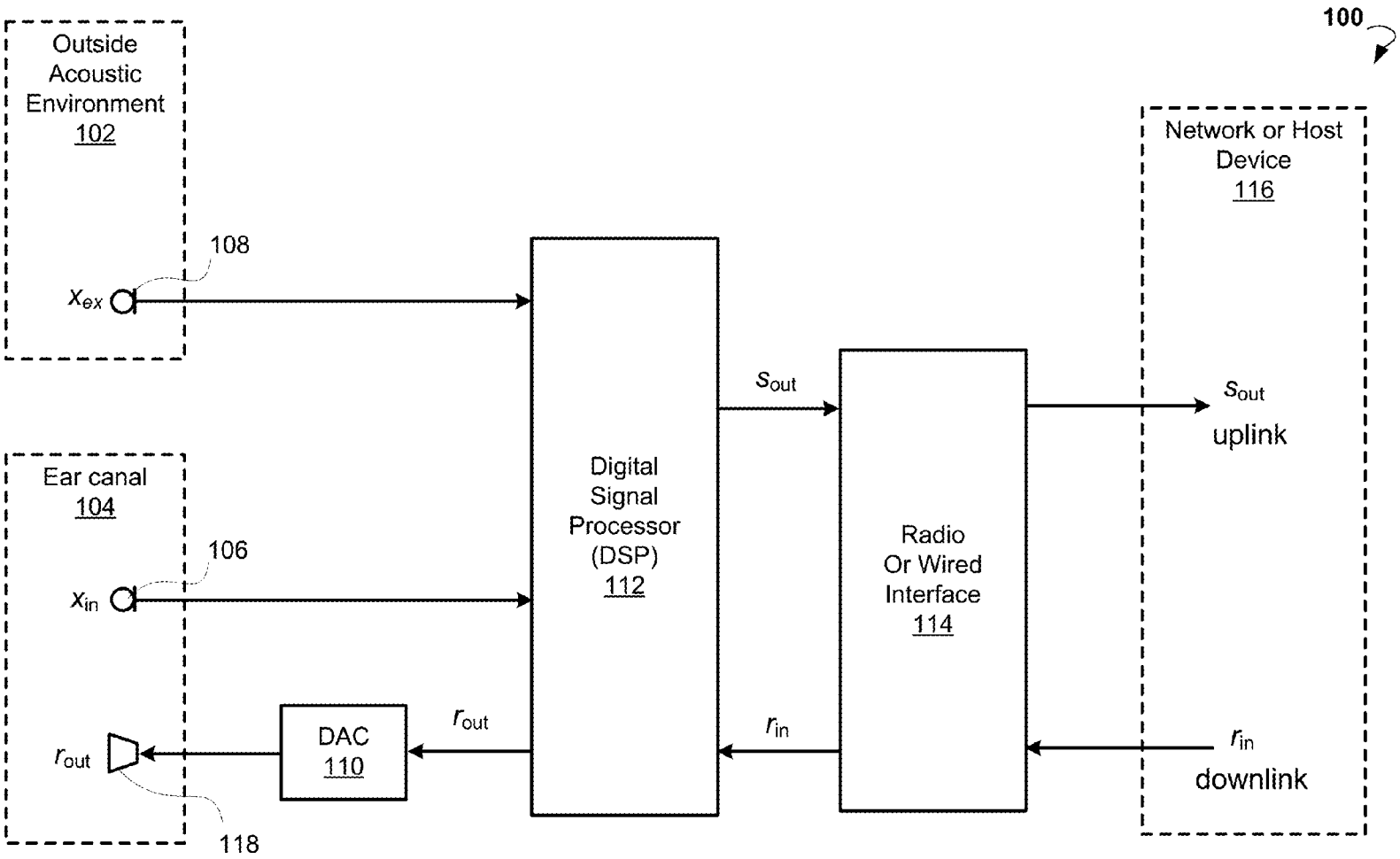
FIG. 1 is a block diagram of a system and an environment in which methods and systems described herein can be practiced, according to an example embodiment.

Referring now to FIG. 1, a block diagram of an example system 100 suitable for providing consistency in noise reduction during speech and non-speech periods and environment thereof are shown. The example system 100 includes at least an internal microphone 106, an external microphone 108, a digital signal processor (DSP) 112, and a radio or wired interface 114. The internal microphone 106 is located inside a user's ear canal 104 and is relatively shielded from the outside acoustic environment 102. The external microphone 108 is located outside of the user's ear canal 104 and is exposed to the outside acoustic environment 102.

In various embodiments, the microphones 106 and 108 are either analog or digital. In either case, the outputs from the microphones are converted into synchronized pulse coded modulation (PCM) format at a suitable sampling frequency and connected to the input port of the digital signal processor (DSP) 112. The signals $x_{in}$ and $x_{ex}$ denote signals representing sounds captured by internal microphone 106 and external microphone 108, respectively.

The DSP 112 performs appropriate signal processing tasks to improve the quality of microphone signals $x_{in}$ and $x_{ex}$. The output of DSP 112, referred to as the send-out signal ($s_{out}$), is transmitted to the desired destination, for example, to a network or host device 116 (see signal identified as $s_{out}$ uplink), through a radio or wired interface 114.

If a two-way voice communication is needed, a signal is received by the network or host device 116 from a suitable source (e.g., via the wireless or wired interface 114). This is referred to as the receive-in signal ($r_{in}$) (identified as $r_{in}$ downlink at the network or host device 116). The receive-in signal can be coupled via the radio or wired interface 114 to the DSP 112 for processing. The resulting signal, referred to as the receive-out signal ($r_{out}$), is converted into an analog signal through a digital-to-analog convertor (DAC) 110 and then connected to a loudspeaker 118 in order to be presented to the user. In some embodiments, the loudspeaker 118 is located in the same ear canal 104 as the internal microphone 106. In other embodiments, the loudspeaker 118 is located in the ear canal opposite the ear canal 104. In example of FIG. 1, the loudspeaker 118 is found in the same ear canal as the internal microphone 106; therefore, an acoustic echo canceller (AEC) may be needed to prevent the feedback of the received signal to the other end. Optionally, in some embodiments, if no further processing of the received signal is necessary, the receive-in signal ($r_{in}$) can be coupled to the loudspeaker without going through the DSP 112. In some embodiments, the receive-in signal $r_{in}$ includes an audio content (for example, music) presented to user. In certain embodiments, receive-in signal $r_{in}$ includes a far end signal, for example a speech during a phone call.

Figure 2:
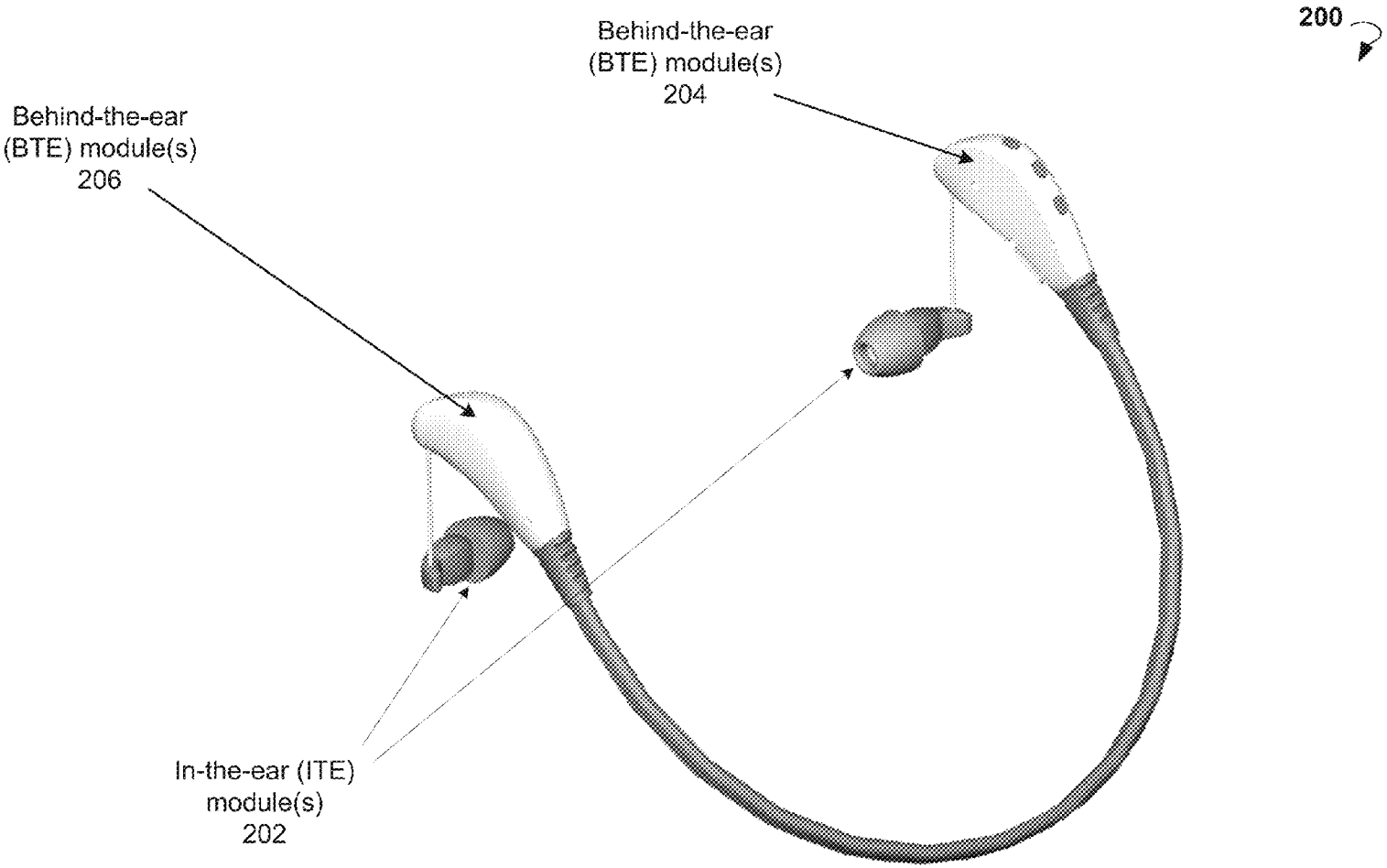
FIG. 2 is a block diagram of a headset suitable for implementing the present technology, according to an example embodiment.

FIG. 2 shows an example headset 200 suitable for implementing methods of the present disclosure. The headset 200 includes example inside-the-ear (ITE) module(s) 202 and behind-the-ear (BTE) modules 204 and 206 for each ear of a user. The ITE module(s) 202 are configured to be inserted into the user's ear canals. The BTE modules 204 and 206 are configured to be placed behind (or otherwise near) the user's ears. In some embodiments, the headset 200 communicates with host devices through a wireless radio link. The wireless radio link may conform to a Bluetooth Low Energy (BLE), other Bluetooth, 802.11, or other suitable wireless standard and may be variously encrypted for privacy.

In various embodiments, each ITE module 202 includes an internal microphone 106 and the loudspeaker 118 (shown in FIG. 1), both facing inward with respect to the ear canals. The ITE module(s) 202 can provide acoustic isolation between the ear canal(s) 104 and the outside acoustic environment 102.

In some embodiments, each of the BTE modules 204 and 206 includes at least one external microphone 108 (also shown in FIG. 1). In some embodiments, the BTE module 204 includes a DSP 112, control button(s), and wireless radio link to host devices. In certain embodiments, the BTE module 206 includes a suitable battery with charging circuitry.

In some embodiments, the seal of the ITE module(s) 202 is good enough to isolate acoustics waves coming from outside acoustic environment 102. However, when speaking or singing, a user can hear user's own voice reflected by ITE module(s) 202 back into the corresponding ear canal. The sound of voice of the user can be distorted because, while traveling through skull of the user, high frequencies of the sound are substantially attenuated. Thus, the user can hear mostly the low frequencies of the voice. The user's voice cannot be heard by the user outside of the earpieces since the ITE module(s) 202 isolate external sound waves.

Figure 3:
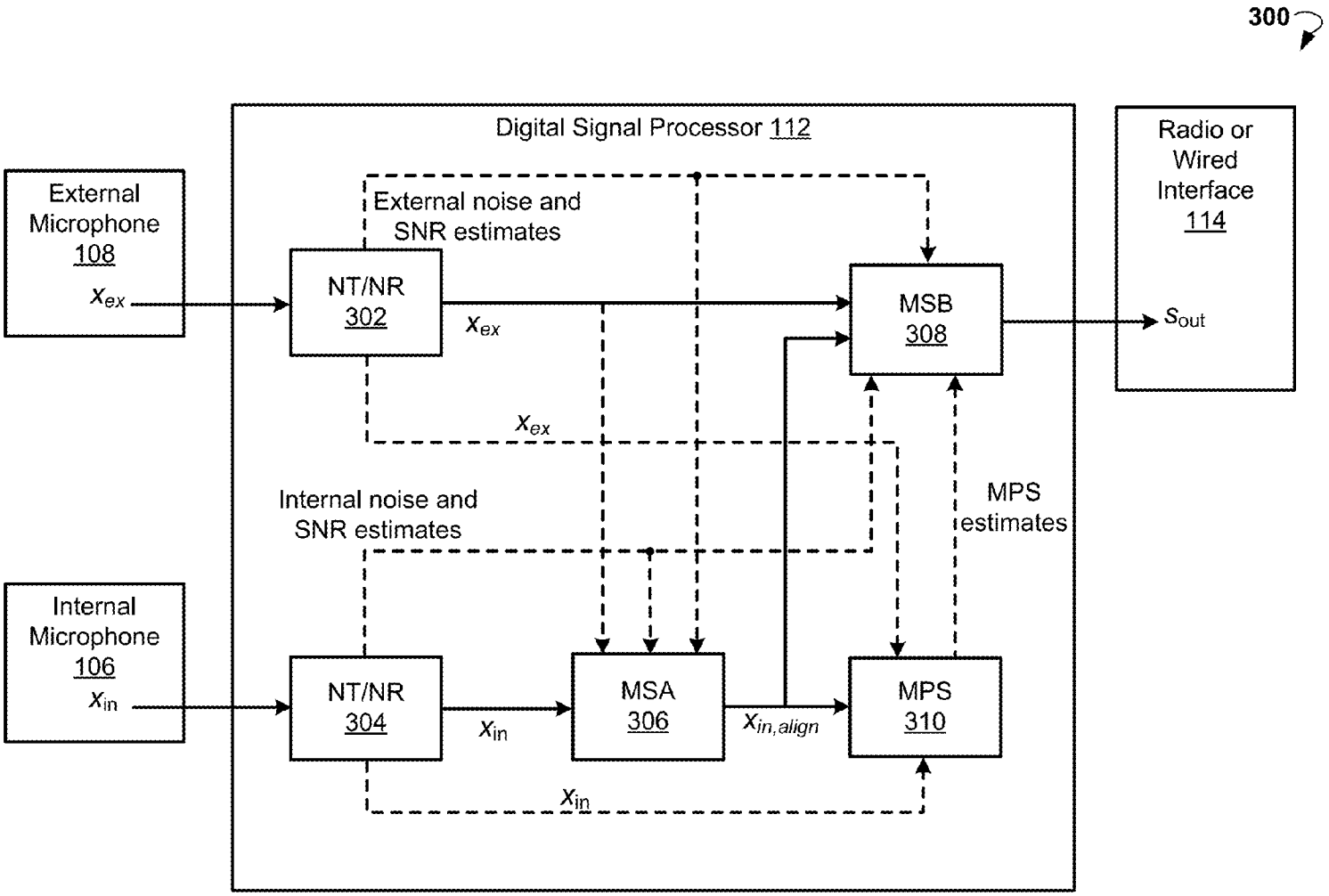
FIG. 3 is a block diagram illustrating a system for providing consistency in noise reduction during speech and non-speech periods, according to an example embodiment.

FIG. 3 illustrates a block diagram 300 of DSP 112 suitable for fusion (blending) of microphone signals, according to various embodiments of the present disclosure. The signals $x_{in}$ and $x_{ex}$ are signals representing sounds captured from, respectively, the internal microphone 106 and external microphone 108. The signals $x_{in}$ and $x_{ex}$ need not be the signals coming directly from the respective microphones; they may represent the signals that are coming directly from the respective microphones. For example, the direct signal outputs from the microphones may be preprocessed in some way, for example, by conversion into a synchronized pulse coded modulation (PCM) format at a suitable sampling frequency, where the method disclosed herein can be used to convert the signal.

In the example in FIG. 3, the signals $x_{in}$ and $x_{ex}$ are first processed by noise tracking/noise reduction (NT/NR) modules 302 and 304 to obtain running estimates of the noise level picked up by each microphone. Optionally, the noise reduction (NR) can be performed by NT/NR modules 302 and 304 by utilizing an estimated noise level.

By way of example and not limitation, suitable noise reduction methods are described by Ephraim and Malah, "*Speech Enhancement Using a Minimum Mean-Square Error Short-Time Spectral Amplitude Estimator*," IEEE Transactions on Acoustics, Speech, and Signal Processing, December 1984, and U.S. patent application Ser. No. 12/832,901 (now U.S. Pat. No. 8,473,287), entitled "Method for Jointly Optimizing Noise Reduction and Voice Quality in a Mono or Multi-Microphone System," filed on Jul. 8, 2010, the disclosures of which are incorporated herein by reference for all purposes.

In various embodiments, the microphone signals $x_{in}$ and $x_{ex}$, with or without NR, and noise estimates (e.g., "external noise and SNR estimates" output from NT/NR module 302 and/or "internal noise and SNR estimates" output from NT/NR module 304) from the NT/NR modules 302 and 304 are sent to a microphone spectral alignment (MSA) module 306, where a spectral alignment filter is adaptively estimated and applied to the internal microphone signal $x_{in}$. A primary purpose of MSA module 306, in the example in FIG. 3; is to spectrally align the voice picked up by the internal microphone 106 to the voice picked up by the external microphone 108 within the effective bandwidth of the in-canal voice signal.

The external microphone signal $x_{ex}$, the spectrally-aligned internal microphone signal $x_{in,align}$, and the estimated noise levels at both microphones 106 and 108 are then sent to a microphone signal blending (MSB) module 308, where the two microphone signals are intelligently combined based on the current signal and noise conditions to form a single output with optimal voice quality. The functionalities of various embodiments of the NT/NR modules 302 and 304, MSA module, and MSB module 308 are discussed in more detail in U.S. patent application Ser. No. 14/853,947, entitled "Microphone Signal Fusion", filed Sep. 14, 2015.

In some embodiments, external microphone signal $x_{ex}$ and the spectrally-aligned internal microphone signal $x_{in,align}$ are blended using blending weights. In certain embodiments, the blending weights are determined in MSB module 308 based on the "external noise and SNR estimates" and the "internal noise and SNR estimates".

For example, MSB module 308 operates in the frequency-domain and determines the blending weights of the external microphone signal and spectral-aligned internal microphone signal in each frequency bin based on the SNR differential between the two signals in the bin. When a user's speech is present (for example, the user of headset 200 is speaking during a phone call) and the outside acoustic environment 102 becomes noisy, the SNR of the external microphone signal $x_{ex}$ becomes lower as compared to the SNR of the internal microphone signal $x_{in}$. Therefore, the blending weights are shifted toward the internal microphone signals $x_{in}$. Because acoustic sealing tends to reduce the noise in the ear canal by 20-30 dB relative to the external environment, the shift can potentially provide 20-30 dB noise reduction relative to the external microphone signal. When the user's speech is absent, the SNRs of both internal and external microphone signals are effectively zero, so the blending weights become evenly distributed between the internal and external microphone signals. Therefore, if the outside acoustic environment is noisy, the resulting blended signal $s_{out}$ includes the part of the noise. The blending of internal microphone signal $x_{in}$ and noisy external microphone signal $x_{ex}$ may result in 3-6 dB noise reduction, which is generally insufficient for extraneous noise conditions.

In various embodiments, the method includes utilizing differences between the power estimates for the external and the internal microphone signals for locating gaps in the speech of the user of headset 200. In certain embodiments, for the gap intervals, blending weight for the external microphone signal is decreased or set to zero and blending weight for the internal microphone signal is increased or set to one before blending of the internal microphone and external microphone signals. Thus, during the gaps in the user's speech, the blending weights are biased to the internal microphone signal, according to various embodiments. As a result, the resulting blended signal contains a lesser amount of the external microphone signal and, therefore, a lesser amount of noise from the outside external environment. When the user is speaking, the blended weights are determined based on "noise and SNR estimates" of internal and external microphone signals. Blending the signals during user's speech improves the quality of the signal. For example, the blending of the signals can improve a quality of signals delivered to the far-end talker during a phone call or to an automatic speech recognition system by the radio or wired interface 114.

In various embodiments, DSP 112 includes a microphone power spread (MPS) module 310 as shown in FIG. 3. In certain embodiments, MPS module 310 is operable to track full-band power for both external microphone signal $x_{ex}$ and internal microphone signal $x_{in}$. In some embodiments, MPS module 310 tracks full-band power of the spectrally-aligned internal microphone signal $x_{in,align}$ instead of the raw internal microphone signal $x_{in}$. In some embodiments, power spreads for the internal microphone signal and external microphone signal are estimated. In clean speech conditions, the powers of both the internal microphone and external microphone signals tend to follow each other. A wide power spread indicates the presence of an excessive noise in the microphone signal with much higher power.

In various embodiments, the MPS module 310 generates microphone power spread (MPS) estimates for the internal microphone signal and external microphone signal. The MPS estimates are provided to MSB module 308. In certain embodiments, the MPS estimates are used for a supplemental control of microphone signal blending. In some embodiments, MSB module 308 applies a global bias toward the microphone signal with significantly lower full-band power, for example, by increasing the weights for that microphone signal and decreasing the weights for the other microphone signal (i.e., shifting the weights toward the microphone signal with significantly lower full-band power) before the two microphone signals are blended.

Figure 4:
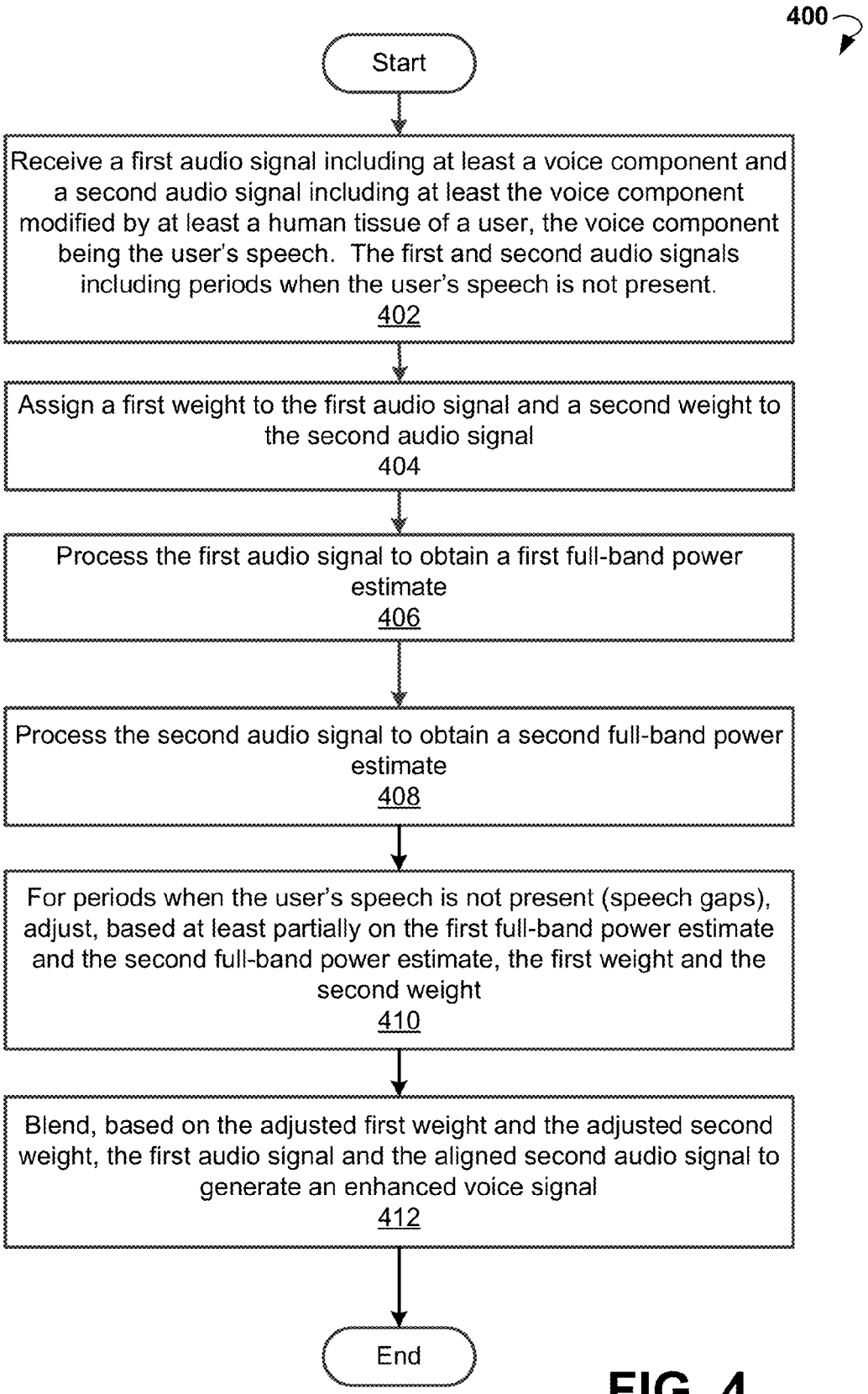
FIG. 4 is a flow chart showing steps of a method for providing consistency in noise reduction during speech and non-speech periods, according to an example embodiment.

FIG. 4 is a flow chart showing steps of method 400 for providing consistency in noise reduction during speech and non-speech periods, according to various example embodiments. The example method 400 can commence with receiving a first audio signal and a second audio signal in block 402. The first audio signal includes at least a voice component and a second audio signal includes the voice component modified by at least a human tissue.

In block 404, method 400 can proceed with assigning a first weight to the first audio signal and a second weight to the second audio signal. In some embodiments, prior to assigning the first weight and the second weight, the first audio signal and the second audio signal are transformed into subband signals and, therefore, assigning of the weights may be performed per each subband. In some embodiments, the first weight and the second weight are determined based on noise estimates in the first audio signal and the second audio signal. In certain embodiments, when the user's speech is present, the first weight and the second weight are assigned based on subband SNR estimates in the first audio signal and the second audio signal.

In block 406, method 400 can proceed with processing the first audio signal to obtain a first full-band power estimate. In block 408, method 400 can proceed with processing the second audio signal to obtain a second full-band power estimate. In block 410, during speech gaps when the user's speech is not present, the first weight and the second weight may be adjusted based, at least partially, on the first full-band power estimate and the second full-band power estimate. In some embodiments, if the first full-band power estimate is less than the second full-band estimate, the first weight and the second weight are shifted towards the first weight. If the second full-band power estimate is less than the first full-band estimate, the first weight and the second weight are shifted towards the second weight.

In block 412, the first signal and the second signal can be used to generate an enhanced voice signal by being blended together based on the adjusted first weight and the adjusted second weight.

Figure 5:
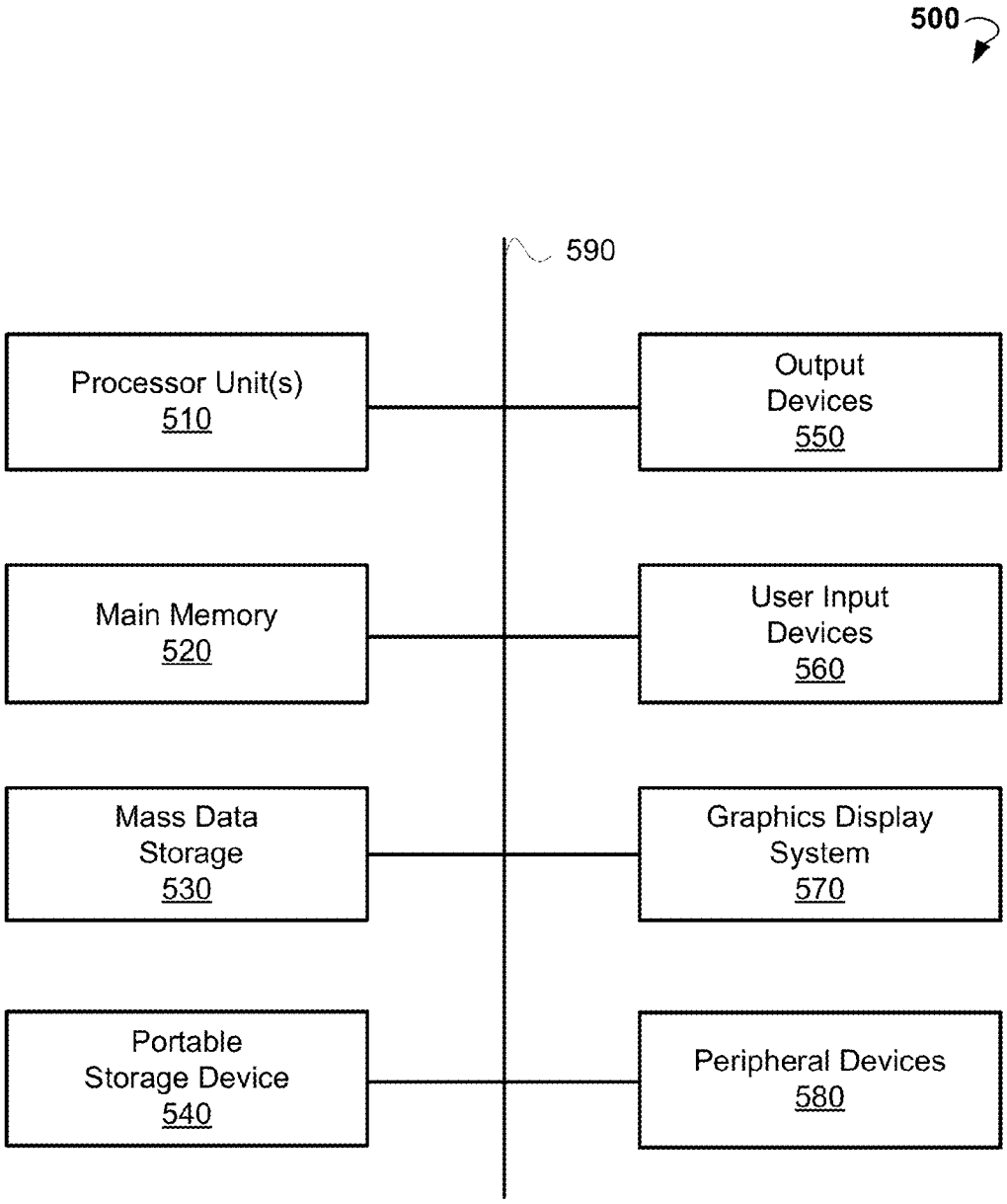
FIG. 5 illustrates an example of a computer system that can be used to implement embodiments of the disclosed technology.

FIG. 5 illustrates an exemplary computer system 500 that may be used to implement some embodiments of the present invention. The computer system 500 of FIG. 5 may be implemented in the contexts of the likes of computing systems, networks, servers, or combinations thereof. The computer system 500 of FIG. 5 includes one or more processor unit(s) 510 and main memory 520. Main memory 520 stores, in part, instructions and data for execution by processor units 510. Main memory 520 stores the executable code when in operation, in this example. The computer system 500 of FIG. 5 further includes a mass data storage 530, portable storage device 540, output devices 550, user input devices 560, a graphics display system 570, and peripheral devices 580.

The components shown in FIG. 5 are depicted as being connected via a single bus 590. The components may be connected through one or more data transport means. Processor unit(s) 510 and main memory 520 is connected via a local microprocessor bus, and the mass data storage 530, peripheral devices 580, portable storage device 540, and graphics display system 570 are connected via one or more input/output (I/O) buses.

Mass data storage 530, which can be implemented with a magnetic disk drive, solid state drive, or an optical disk drive, is a non-volatile storage device for storing data and instructions for use by processor unit(s) 510. Mass data storage 530 stores the system software for implementing embodiments of the present disclosure for purposes of loading that software into main memory 520.

Portable storage device 540 operates in conjunction with a portable non-volatile storage medium, such as a flash drive, floppy disk, compact disk, digital video disc, or Universal Serial Bus (USB) storage device, to input and output data and code to and from the computer system 500 of FIG. 5. The system software for implementing embodiments of the present disclosure is stored on such a portable medium and input to the computer system 500 via the portable storage device 540.

User input devices 560 can provide a portion of a user interface. User input devices 560 may include one or more microphones, an alphanumeric keypad, such as a keyboard, for inputting alphanumeric and other information, or a pointing device, such as a mouse, a trackball, stylus, or cursor direction keys. User input devices 560 can also include a touchscreen. Additionally, the computer system 500 as shown in FIG. 5 includes output devices 550. Suitable output devices 550 include speakers, printers, network interfaces, and monitors.

Graphics display system 570 include a liquid crystal display (LCD) or other suitable display device. Graphics display system 570 is configurable to receive textual and graphical information and processes the information for output to the display device.

Peripheral devices 580 may include any type of computer support device to add additional functionality to the computer system.

The components provided in the computer system 500 of FIG. 5 are those typically found in computer systems that may be suitable for use with embodiments of the present disclosure and are intended to represent a broad category of such computer components that are well known in the art. Thus, the computer system 500 of FIG. 5 can be a personal computer (PC), hand held computer system, telephone, mobile computer system, workstation, tablet, phablet, mobile phone, server, minicomputer, mainframe computer, wearable, or any other computer system. The computer may also include different bus configurations, networked platforms, multi-processor platforms, and the like. Various operating systems may be used including UNIX, LINUX, WINDOWS, MAC OS, PALM OS, QNX ANDROID, IOS, CHROME, TIZEN, and other suitable operating systems.

The processing for various embodiments may be implemented in software that is cloud-based. In some embodiments, the computer system 500 is implemented as a cloud-based computing environment, such as a virtual machine operating within a computing cloud. In other embodiments, the computer system 500 may itself include a cloud-based computing environment, where the functionalities of the computer system 500 are executed in a distributed fashion. Thus, the computer system 500, when configured as a computing cloud, may include pluralities of computing devices in various forms, as will be described in greater detail below.

In general, a cloud-based computing environment is a resource that typically combines the computational power of a large grouping of processors (such as within web servers) and/or that combines the storage capacity of a large grouping of computer memories or storage devices. Systems that provide cloud-based resources may be utilized exclusively by their owners or such systems may be accessible to outside users who deploy applications within the computing infrastructure to obtain the benefit of large computational or storage resources.

The cloud may be formed, for example, by a network of web servers that comprise a plurality of computing devices, such as the computer system 500, with each server (or at least a plurality thereof) providing processor and/or storage resources. These servers may manage workloads provided by multiple users (e.g., cloud resource customers or other users). Typically, each user places workload demands upon the cloud that vary in real-time, sometimes dramatically. The nature and extent of these variations typically depends on the type of business associated with the user.

The present technology is described above with reference to example embodiments. Therefore, other variations upon the example embodiments are intended to be covered by the present disclosure.

What is claimed is:

1. A method for audio processing, the method comprising:

receiving a first signal including at least a voice component and a second signal including at least the voice component modified by at least a human tissue of a user, the voice component being speech of the user, the first and second signals including periods when the speech of the user is not present;

assigning a first weight to the first signal and a second weight to the second signal;

processing the first signal to obtain a first power estimate;

processing the second signal to obtain a second power estimate;

utilizing the first and second power estimates to identify the periods when the speech of the user is not present;

for the periods that have been identified to be when the speech of the user is not present, performing one or both of decreasing the first weight and increasing the second weight so as to enhance the level of the second signal relative to the first signal;

blending, based on the first weight and the second weight, the first signal and the second signal to generate an enhanced voice signal; and prior to the assigning, aligning the second signal with the first signal, the aligning including applying a spectral alignment filter to the second signal.

2. The method of claim 1, further comprising:
further processing the first signal to obtain a first full-band power estimate;
further processing the second signal to obtain a second full-band power estimate;
determining a minimum value between the first full-band power estimate and the second full-band power estimate; and
based on the determination:
increasing the first weight and decreasing the second weight when the minimum value corresponds to the first full-band power estimate; and
increasing the second weight and decreasing the first weight when the minimum value corresponds to the second full-band power estimate.

3. The method of claim 2, wherein the increasing and decreasing is carried out by applying a shift.

4. The method of claim 3, wherein the shift is calculated based on a difference between the first full-band power estimate and the second full-band power estimate, the shift receiving a larger value for a larger difference value.

5. The method of claim 4, further comprising:
prior to the increasing and decreasing, determining that the difference exceeds a pre-determined threshold; and
based on the determination, applying the shift if the difference exceeds the pre-determined threshold.

6. The method of claim 1, wherein the first signal and the second signal are transformed into subband signals.

7. The method of claim 6, wherein, for the periods when the speech of the user is present, the assigning the first weight and the second weight is carried out per subband by performing the following:
processing the first signal to obtain a first signal-to-noise ratio (SNR) for the subband;
processing the second signal to obtain a second SNR for the subband;
comparing the first SNR and the second SNR; and
based on the comparison, assigning a first value to the first weight for the subband and a second value to the second weight for the subband, and wherein:
the first value is larger than the second value if the first SNR is larger than the second SNR;
the second value is larger than the first value if the second SNR is larger than the first SNR; and
a difference between the first value and the second value depends on a difference between the first SNR and the second SNR.

8. The method of claim 1, wherein the second signal represents at least one sound captured by an internal microphone located inside an ear canal.

9. The method of claim 8, wherein the internal microphone is at least partially sealed for isolation from acoustic signals external to the ear canal.

10. The method of claim 1, wherein the first signal represents at least one sound captured by an external microphone located outside an ear canal.

11. The method of claim 1, wherein the assigning of the first weight and the second weight includes:
determining, based on the first signal, a first noise estimate;
determining, based on the second signal, a second noise estimate; and
calculating, based on the first noise estimate and the second noise estimate, the first weight and the second weight.

12. The method of claim 1, wherein the blending includes mixing the first signal and the second signal according to the first weight and the second weight.

13. A system for audio processing, the system comprising:
a processor; and
a memory communicatively coupled with the processor, the memory storing instructions, which, when executed by the processor, perform a method comprising:
receiving a first signal including at least a voice component and a second signal including at least the voice component modified by at least a human tissue of a user, the voice component being speech of the user, the first and second signals including periods when the speech of the user is not present;
assigning a first weight to the first signal and a second weight to the second signal;
processing the first signal to obtain a first power estimate;
processing the second signal to obtain a second power estimate;
utilizing the first and second power estimates to identify the periods when the speech of the user is not present;
for the periods that have been identified to be when the speech of the user is not present, performing one or both of decreasing the first weight and increasing the second weight so as to enhance the level of the second signal relative to the first signal;
blending, based on the first weight and the second weight, the first signal and the second signal to generate an enhanced voice signal; and
prior to the assigning, aligning the second signal with the first signal, the aligning including applying a spectral alignment filter to the second signal.

14. The system of claim 13, wherein the method further comprises:
further processing the first signal to obtain a first full-band power estimate;
further processing the second signal to obtain a second full-band power estimate;
determining a minimum value between the first full-band power estimate and the second full-band power estimate; and
based on the determination:
increasing the first weight and decreasing the second weight when the minimum value corresponds to the first full-band power estimate; and
increasing the second weight and decreasing the first weight when the minimum value corresponds to the second full-band power estimate.

15. The system of claim 14, wherein the increasing and decreasing is carried out by applying a shift.

16. The system of claim 15, wherein the shift is calculated based on a difference of the first full-band power estimate and the second full-band power estimate, the shift receiving a larger value for a larger value difference.

17. The system of claim 16, further comprising:
prior to the increasing and decreasing, determining that the difference exceeds a pre-determined threshold; and
based on the determination, applying the shift if the difference exceeds the pre-determined threshold.

18. The system of claim 13, wherein the first signal and the second signal are transformed into subband signals.

19. The system of claim 18, wherein, for the periods when the speech of the user is present, the assigning the first weight and the second weight is carried out per subband by performing the following:

processing the first signal to obtain a first signal-to-noise ratio (SNR) for the subband;

processing the second signal to obtain a second SNR for the subband;

comparing the first SNR and the second SNR; and based on the comparison, assigning a first value to the first weight for the subband and a second value to the second weight for the subband, and wherein:

the first value is larger than the second value if the first SNR is larger than the second SNR;

the second value is larger than the first value if the second SNR is larger than the first SNR; and a difference between the first value and the second value depends on a difference between the first SNR and the second SNR.

20. The system of claim 13, wherein the second signal represents at least one sound captured by an internal microphone located inside an ear canal.

21. The system of claim 20, wherein the internal microphone is at least partially sealed for isolation from acoustic signals external to the ear canal.

22. The system of claim 13, wherein the first signal represents at least one sound captured by an external microphone located outside an ear canal.

23. The system of claim 13, wherein the assigning the first weight and the second weight includes:

determining, based on the first signal, a first noise estimate;

determining, based on the second signal, a second noise estimate; and calculating, based on the first noise estimate and the second noise estimate, the first weight and the second weight.

24. A non-transitory computer-readable storage medium having embodied thereon instructions, which, when executed by at least one processor, perform steps of a method, the method comprising:

receiving a first signal including at least a voice component and a second signal including at least the voice component modified by at least a human tissue of a user, the voice component being speech of the user, the first and second signals including periods when the speech of the user is not present;

determining, based on the first signal, a first noise estimate;

determining, based on the second signal, a second noise estimate;

assigning, based on the first noise estimate and second noise estimate, a first weight to the first signal and a second weight to the second signal;

processing the first signal to obtain a first power estimate;

processing the second signal to obtain a second power estimate;

utilizing the first and second power estimates to identify the periods when the speech of the user is not present;

for the periods that have been identified to be when the speech of the user is not present, performing one or both of decreasing the first weight and increasing the second weight so as to enhance the level of the second signal relative to the first signal;

blending, based on the first weight and the second weight, the first signal and the second signal to generate an enhanced voice signal; and prior to the assigning, aligning the second signal with the first signal, the aligning including applying a spectral alignment filter to the second signal.

* * * * *